US011871833B2

(12) United States Patent
Jesberg et al.

(10) Patent No.: US 11,871,833 B2
(45) Date of Patent: Jan. 16, 2024

(54) COSMETIC CONTAINERS, IN PARTICULAR MASCARA CONTAINERS

(71) Applicant: Seidel GmbH & Co. KG, Marburg (DE)

(72) Inventors: Silke Jesberg, Wetter (DE); Andreas Franz Christian Ritzenhoff, Marburg (DE); Michael Kurz, Neustadt (DE)

(73) Assignee: SEIDEL GMBH & CO. KG, Marburg (DE)

( * ) Notice: Subject to any disclaimer, the term of this patent is extended or adjusted under 35 U.S.C. 154(b) by 0 days.

(21) Appl. No.: 17/828,757

(22) Filed: May 31, 2022

(65) Prior Publication Data

US 2022/0378174 A1 Dec. 1, 2022

(30) Foreign Application Priority Data

Jun. 1, 2021 (EP) ..... 21177093

(51) Int. Cl.

| | |
|---|---|
| ***A45D 34/04*** | (2006.01) |
| ***A45D 40/26*** | (2006.01) |
| ***A46B 5/00*** | (2006.01) |
| ***A46B 9/02*** | (2006.01) |
| ***A46B 11/00*** | (2006.01) |

(52) U.S. Cl.

CPC ..... *A45D 34/046* (2013.01); *A46B 5/0095* (2013.01); *A46B 9/021* (2013.01); *A46B 11/0079* (2013.01); *A45D 34/045* (2013.01); *A45D 40/265* (2013.01); *A45D 40/267* (2013.01); *A46B 2200/1053* (2013.01)

(58) Field of Classification Search

CPC .. A45D 34/046; A45D 34/045; A45D 40/265; A46B 5/0095; A46B 9/021; A46B 11/0079; A46B 2200/1053

USPC ..... 401/121, 122, 126–130

See application file for complete search history.

(56) References Cited

U.S. PATENT DOCUMENTS

| | | | | |
|---|---|---|---|---|
| 6,450,179 | B2 * | 9/2002 | Bengis | A63H 33/28 132/297 |
| 2016/0015151 | A1 * | 1/2016 | Balestrini | A45D 34/046 401/122 |
| 2016/0174679 | A1 * | 6/2016 | Gorostiza | A45D 29/20 132/75.3 |

* cited by examiner

*Primary Examiner* — David J Walczak

(74) *Attorney, Agent, or Firm* — Dickinson Wright PLLC; Andrew D. Dorisio

(57) ABSTRACT

A cosmetics container is disclosed, in particular a mascara container (400), whose components are a container part (401), a container cap (402), a wiper (436), which is inserted into a container neck disposed on a container part, and an applicator (403), which is connected to the container cap and passes through the wiper with a brush rod provided with an applicator brush on its free end. Material intersections, which are realised as detachable form-fit, detachable substance-to-substance or detachable force-fit connections, are formed least partially between the different or coinciding materials for separation purposes, a joining end (412) of the brush rod (411) being connected to an applicator holder (414) by way of a bayonet joint (413).

8 Claims, 7 Drawing Sheets

COSMETIC CONTAINERS, IN PARTICULAR MASCARA CONTAINERS

TECHNICAL FIELD

The invention relates to a cosmetics container, in particular a mascara container, whose components are a container part, a container cap, a wiper, which is inserted into a container neck disposed on a container part, and an applicator, which is connected to the container cap and passes through the wiper with a brush rod provided with an applicator brush on its free end.

BACKGROUND

Cosmetics containers of the type mentioned above are commonly realised as material hybrids, which means that the cosmetics containers made of a plurality of components comprise components which consist of different materials. The cosmetics containers mentioned above are mostly made of material hybrids or material mixes made of aluminium and plastic, meaning an effective recycling presumes separating the materials in particular in the case when the respective material portion exceeds a certain range. Separating the materials is often time-consuming, in particular when separating the materials cannot be carried out economically means sacrificing the inferior or less valuable material to enable recycling the more valuable material portion. This can occur, for example, when cosmetics containers, which have aluminium and plastic components, are molten for recycling purposes so that the material is separated in this case by burning or gasifying the plastic portion.

An extensive recycling of a cosmetics container made of several components becomes possible using two different approaches, for example, the cosmetics container of the first approach being designed such that the individual components can be easily separated from each other, while the second approach strives for a plastic portion as small as possible to limit the non-recyclable portion of the cosmetics container to a minimum when sacrificing plastic material.

SUMMARY

The object of the present invention is therefore to propose a cosmetics container which enables a simplified separation of materials.

According to the invention, material intersections are formed at least partially in the cosmetics container, whose wiper is made of a plastic material in contrast to at least one of the other previously mentioned components, between the different materials or components for separation purposes, the material intersections being realised as detachable form-fit, detachable substance-to-substance or detachable force-fit connections so that the cosmetics container according to the invention does not have to supplied to the recycling process as a whole unit, but instead the components can be separated before recycling takes place owing to the material intersections for the subsequent supply of the components to the different recycling methods or non-recyclable materials or materials which can only be recycled with great effort can be separated from the materials which are comparatively better suited for recycling. For the simplified separation of materials independently of a set of recycling problems, a joining end of the brush rod is connected to an applicator holder by means of a bayonet joint.

Independently of a set of problems regarding recycling, a bayonet joint between an applicator holder and an applicator for a cosmetics container, which is provided with an applicator and is realised as a mascara container, is advantageous as an applicator can be easily exchanged. This advantage of course exists independently of whether the components of the container are made of different or the same material. In the case of a mascara container, the wiper can therefore be made of any arbitrary material, as long as the wiper fulfils its function. The wiper can be made not only of plastic but also of a material deviating from the material used for the other components.

It is particularly advantageous if the wiper is made of a plastic material in deviation from one of the other previously mentioned components.

The cosmetics container according to the invention also makes it possible to reduce the plastic portion to a range as small possible, e.g., less than 10%, and to choose a uniform recycling method for the other components, in particular in the case when these materials consist of a uniform material, such as in particular aluminium.

In any case, the cosmetics container according to the invention consequently also simplifies recycling the cosmetics container.

It is particularly advantageous if the container cap comprises a cap outer part and a cap inner part, which each comprise a sleeve part, the two sleeve parts being connected to each other via a press-fit connection, an adhesive connection or a welding connection. Differentiating between a cap outer part and a cap inner part enables using different materials, if required, for the cap outer part and the cap inner part while also forming a suitable detachable material intersection between the sleeve parts to enable an overall high portion of a recyclable material of the container cap.

If the applicator is held in the cap inner part by means of the applicator holder, an intersection, which enables separating the applicator from the container cap or the cap inner part particularly easily, can be defined by the applicator holder.

Preferably, the applicator holder comprises a connective or joining area for being connected to the cap inner part so that separating the applicator holder and the cap inner part is also possible.

Preferably for this purpose, the applicator holder comprises a cup-shaped receiving part for receiving the joining end having a connective protrusion formed on a cup bottom, such that a projection of the connective protrusion, which protrudes over an opening edge of a receiving opening formed in the cap bottom of the cap inner part, engages behind the opening edge after deformation in order to be connected to the cap inner part, so that a formation can take place via an ultrasonic welding process, with the result that for separating the applicator holder from the cap inner part, merely the material projection needs to be separated.

If the joining end of the brush rod comprises two radially protruding pins, which are disposed at a distance a axially from a stop collar and serve for engaging in a locking groove each, the locking grooves each being formed in a cup wall of the applicator holder at a distance a to a cup edge, the bayonet joint can be realised using particularly little material.

Preferably, the stop collar simultaneously serves for the sealing abutment against an opening edge of an opening formed for passing the brush rod through the wiper, so that a separate seal need not be provided.

If the wiper comprises a stop collar in an axial end of a sleeve inserted into the container neck for the outer abutment against an opening edge of the container neck and comprises several fastening tabs, which are dispersed across the circumference of a sleeve edge on opposite axial ends of the sleeve and engage behind an inner shoulder, which is formed on the container neck, when deformed radially outward, a material connection between the wiper and the container neck which can be detached particularly easily can be realised.

BRIEF DESCRIPTION OF THE DRAWINGS

Advantageous embodiments of the cosmetics container are described in further detail using the drawings.

FIG. 1 shows an isometric view of an embodiment of a cosmetics container according to;

DETAILED DESCRIPTION

Figure 1:
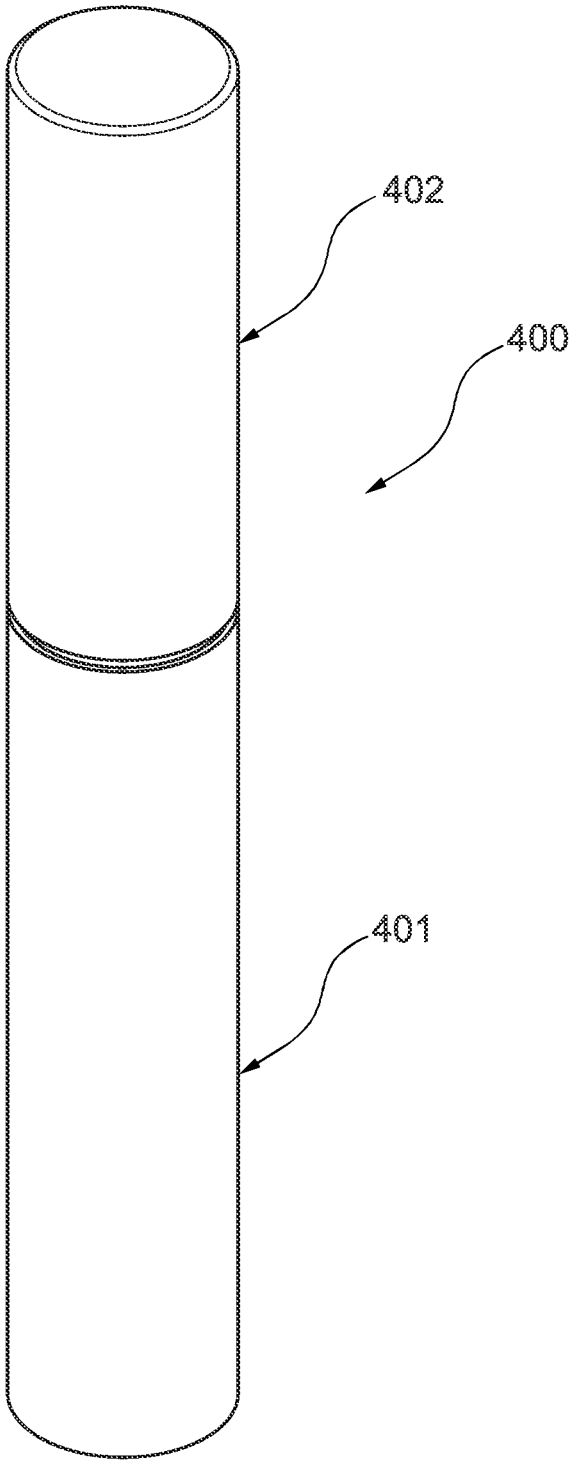
Figure 2:
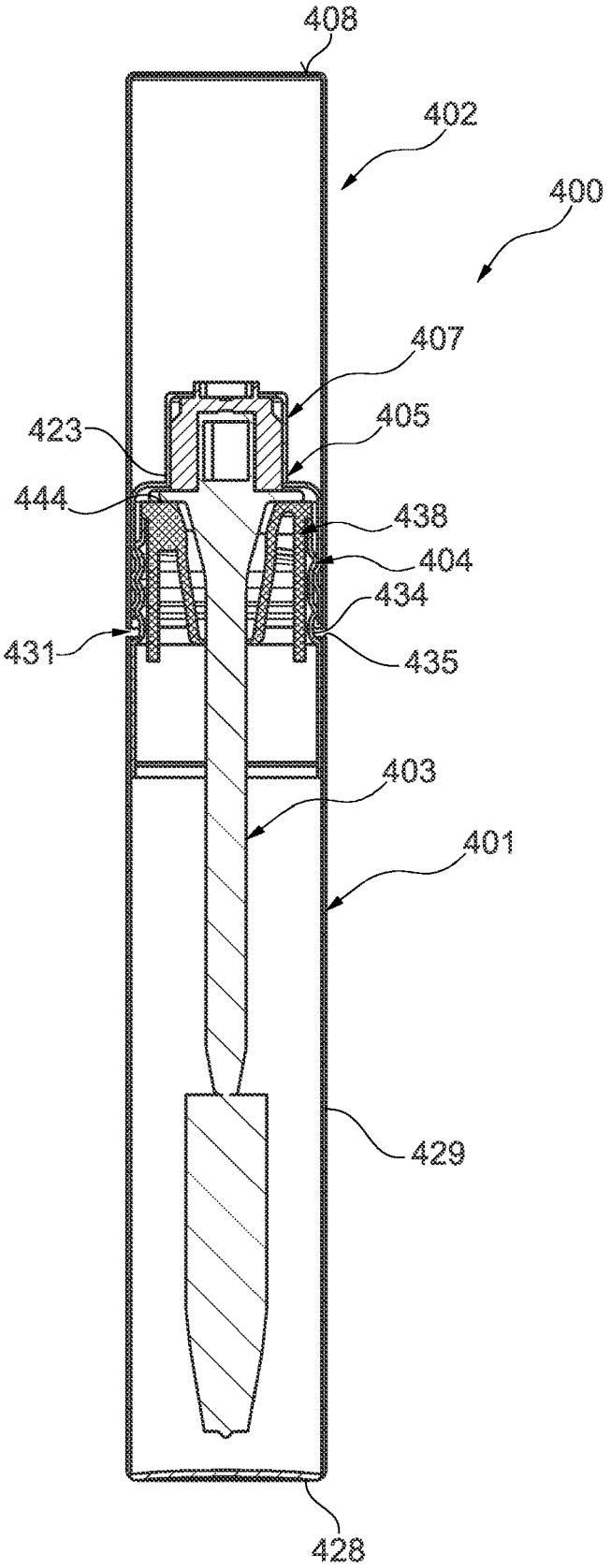
FIG. 2 shows a longitudinal cut of the cosmetics container shown in FIG. 1.

FIGS. 1 to 7 show a mascara container 400 as one embodiment of the cosmetics container according to the invention, mascara container 400 comprising a container part 401 and a container cap 402 provided with an applicator 403, as in particular FIGS. 1 and 2 show.

As FIG. 2 shows, container cap 402 comprises a cap inner part 405 provided with a cap thread 404 and a cap outer part 406, both cap inner part 405 and cap outer part 406 being sleeve-shaped and each comprising a cap bottom 407, 408 on one end and each comprising an opening edge 409, 410, which are disposed on opposite ends of cap bottoms 407, 408 and between which a connection is produced, which can be realized as a press-fit connection, an adhesive connection or a welding connection.

As in particular a synopsis of FIGS. 4 to 7 clearly shows, applicator 403 comprises a brush rod 411 whose joining end 412 is connected to an applicator holder 414 by means of a bayonet joint 413, applicator holder 414 being received in a recess 415 formed in cap bottom 407 of cap inner part 405.

Applicator holder 414 comprises a cup-shaped receiving part 416 (FIG. 5) for receiving joining end 412 with a connective protrusion 417 formed on a cup bottom, a projection 420 of connective protrusion 417, which protrudes over an opening edge 418 of a receiving opening 419 formed in cap bottom 407 of cap inner part 405, engaging behind opening edge 418 after a deformation which is not illustrated and preferably takes place by means of an ultrasonic welding tool in order to connect applicator holder 414 to cap inner part 405.

Figure 6:
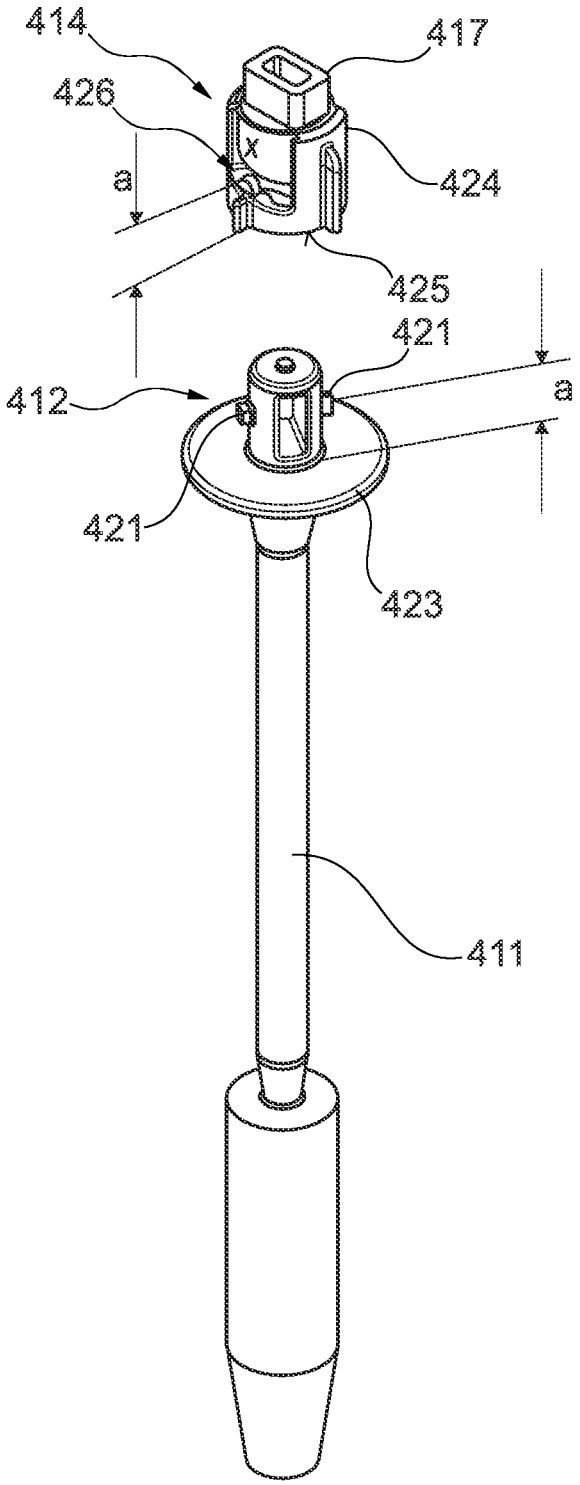
FIG. 6 shows a first isometric view of the applicator shown in FIG. 5 with an applicator holder removed from the applicator.

To form bayonet joint 413, joining end 412 of brush rod 411 comprises two radially protruding, diametrically opposite pins 421, which, as in particular FIG. 6 shows, are disposed at a distance a from a stop collar 423 of brush rod 411 and enable an engagement in a locking groove 426 each, which are formed in a cup wall 424 of applicator holder 414 at a distance a from a cup edge 425.

Figure 7:
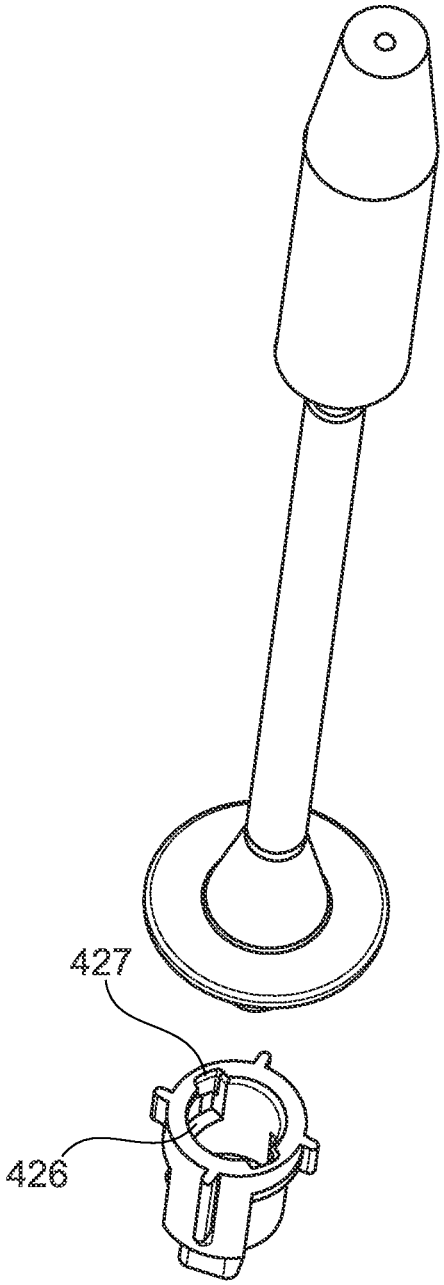
FIG. 7 shows another isometric view of the applicator holder removed from the applicator.

As FIG. 7 shows, an axially oriented insertion groove 427 is provided for each pin 421 for inserting pins 421 into locking grooves 426 in cup wall 424, such that after inserting joining end 412 into applicator holder 414 by means of an axial feed movement via a subsequent rotation of brush rod 411 around its longitudinal axis, pins 421 can be locked in locking grooves 426. For this purpose, a pretension, which secures the joining end 412 of brush rod 411 in applicator holder 414, can be produced via an embodiment of locking grooves 426, which inclines slightly in the rotational direction, with an abutment of stop collar 423 against cup edge 425.

Figure 3:
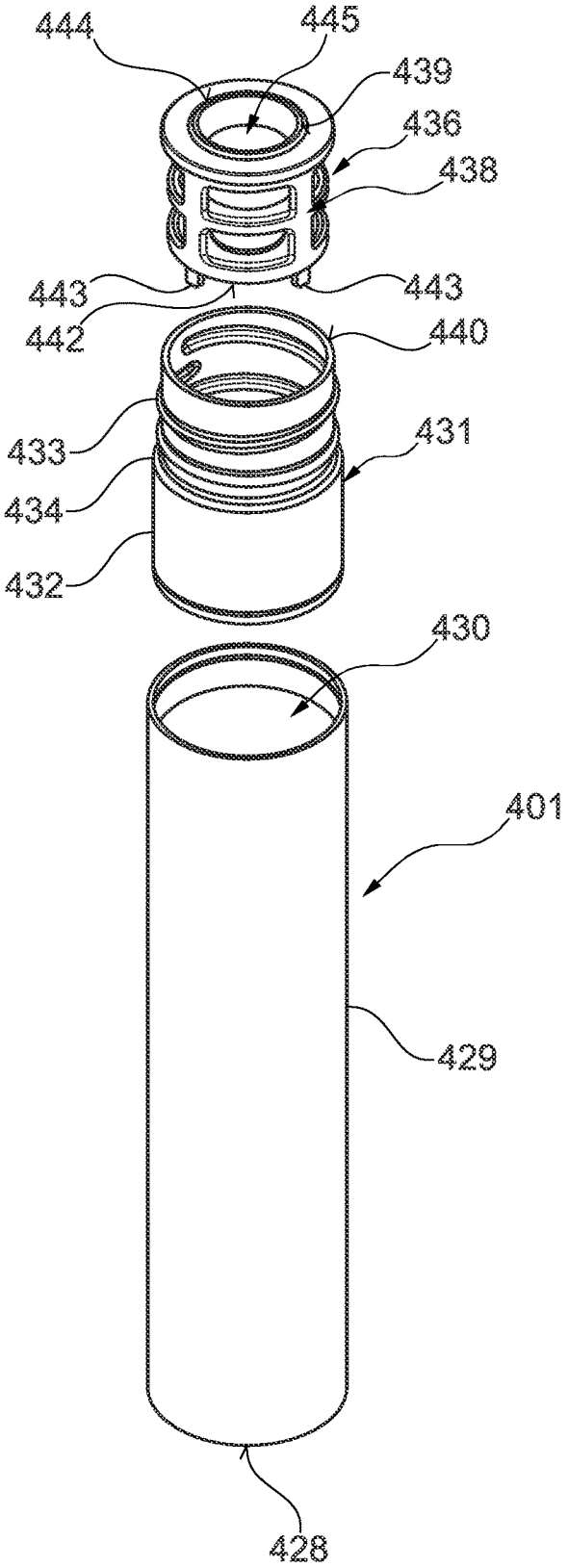
FIG. 3 shows an exploded view of a container part of the cosmetics container shown in FIG. 1.
Figure 4:
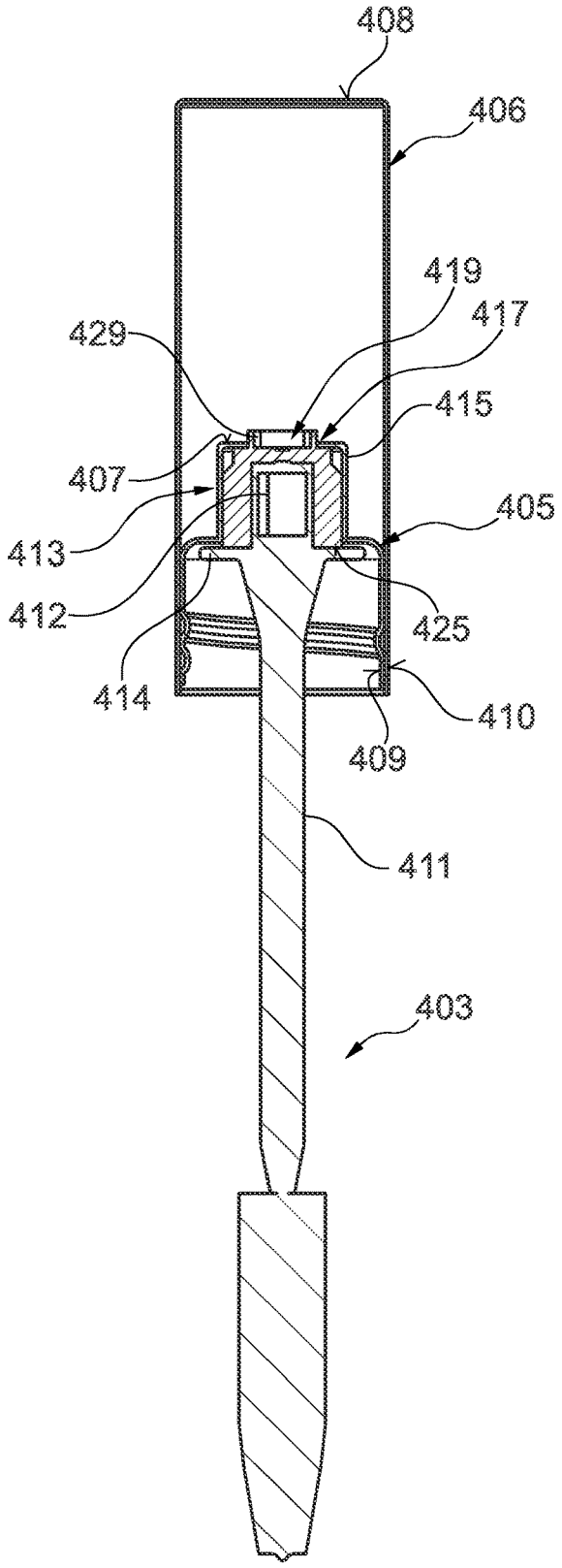
FIG. 4 shows a view of a longitudinal cut of a container cap of the cosmetics container shown in FIG. 1 while connected to an applicator.
Figure 5:
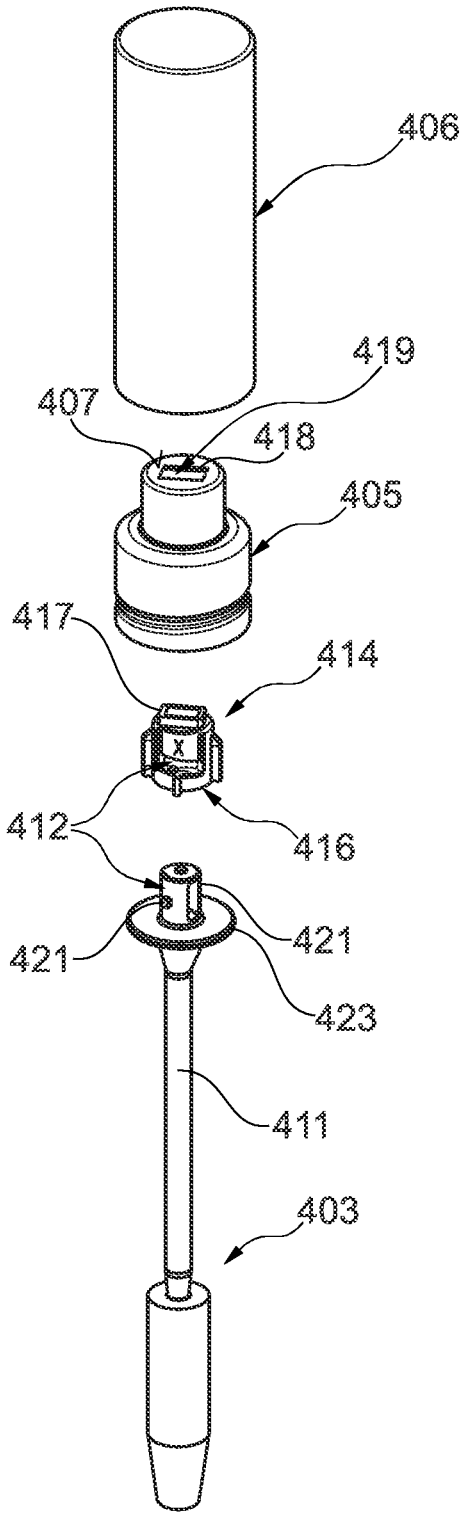
FIG. 5 shows an exploded view of the applicator shown in FIG. 4 while connected to the container cap.

As in particular FIGS. 2 and 3 show, container part 401 comprises a container body 429, which is provided with a bottom 428 and comprises a receiving opening 430 on the end opposite bottom 428 for receiving a container neck 431. A connective end 432 of container neck 431, whose outer diameter corresponds in size to the inner diameter of container body 429, is inserted into receiving opening 430 in such a manner that a shoulder 434 formed in the cross over area to a thread part 433 of container neck 431 is disposed so as to be flush with an opening edge 435 of receiving opening 430.

A wiper 436 made of plastic is inserted into thread part 433. Wiper 436 comprises a stop collar 439 on the upper axial end of a sleeve 438, which is inserted into container neck 431, for the outer abutment against an opening edge 440 of container neck 431. Stop collar 439 limits an opening 445 using an opening edge 444, opening 445 being formed for passing brush rod 411 through wiper 436. Sleeve 438 is provided with a plurality of fastening tabs 443 on its lower axial end, the fastening tabs 443 being dispersed across the circumference of a sleeve edge 442 and which engage behind shoulder 434, which is formed on container neck 431, when deformed radially outward and after wiper 436 has been inserted into container neck 431 for fixating wiper 436 in its position in container neck 431.

The deforming process for deforming fastening tab 443 can take place corresponding to the deforming process of connective protrusion 417 on applicator holder 414 by means of an ultrasonic welding tool. For this purpose, the deforming process (which is comparable to the deforming of connective protrusion 417, which takes place before cap inner part 405 is inserted into cap outer part 406) takes place before container neck 431 is inserted into container body 429.

The invention claimed is:

1. A cosmetics container, in particular a mascara container (400), whose components include:

a container part (401), a container cap (402), a wiper (436), which is inserted into a container neck (431) disposed on the container part (401), and an applicator (403), which is connected to the container cap (402) and passes through the wiper (436) with a brush rod (411) provided with an applicator brush on its free end, characterised in that intersections between the components form connections therebetween, said connections including at least one of a detachable form-fit connection, a detachable substance-to-substance connection, or a detachable force-fit connection, wherein said connections are at least partially formed between the components to allow for separation of the components from one another, wherein a joining end (412) of the brush rod (411) is connected to an applicator holder (414) by means of a bayonet joint (413);

wherein the container cap (402) comprises a cap outer part (406) and a cap inner part (405), which each comprise a sleeve part, which are connected to each other via a press-fit connection, an adhesive connection, or a welding connection;

wherein the applicator (403) is held in the cap inner part (405) by means of the applicator holder (414); and wherein the cap inner part (405) and the applicator holder (414) form different physical entities.

2. The cosmetics container according to claim 1, characterised in that the wiper (436) is made of a plastic material, and wherein at least one of the container part, the container cap, and the applicator is made of a material other than plastic.

3. The cosmetics container according to claim 2, characterised in that the applicator holder (414) comprises a joining area for being connected to the cap inner part (405).

4. The cosmetics container according to claim 3, characterised in that the applicator holder (414) comprises a cup-shaped receiving part (416), which serves for receiving the joining end (412) and has a connective protrusion (417) formed on a cup bottom, such that a projection (420) of the connective protrusion (417), which protrudes over an opening edge (418) of a receiving opening (419) formed in a cap bottom (407), engages behind the opening edge (418) after deformation in order to be connected to the cap inner part (405).

5. The cosmetics container according to claim 3, characterised in that the joining end (412) of the brush rod (411) comprises two radially protruding pins (421), which are disposed axially from a stop collar (423) at a distance a and serve for engaging in a locking groove (426) each formed in a cup wall (424) of the applicator holder (414) at a distance a from a cup edge (425).

6. The cosmetics container according to claim 5, characterised in that the stop collar (423) serves for the sealing abutment against an opening edge (444) of an opening (445) formed for passing the brush rod (411) through the wiper (414).

7. The cosmetics container according to claim 1, characterised in that the wiper (414) comprises a stop collar (439) on an axial end of a sleeve (438), which is inserted in the container neck (431), for the outer abutment against an opening edge (435) of the container neck (431) and comprises several fastening tabs (443) on an opposite axial end of the sleeve (438), the fastening tabs (443) being distributed across a circumference of a sleeve edge (442) and engaging behind an inner shoulder (434) formed on the container neck (431) when deformed radially outward.

8. The cosmetics container of claim 1, wherein the cap inner part (405) comprises a recess (415) adapted for receiving the applicator holder (414).

* * * * *